US005138737A

United States Patent [19]

Thomas

[11] Patent Number: 5,138,737

[45] Date of Patent: Aug. 18, 1992

[54] TOOTHBRUSH

[76] Inventor: Martha M. Thomas, 629 S. Vine St., Denver, Colo. 80209

[21] Appl. No.: 690,547

[22] Filed: Apr. 23, 1991

Related U.S. Application Data

[63] Continuation-in-part of Ser. No. 421,984, Oct. 16, 1989.

[51] Int. Cl.[5] ..... A46B 5/02; A46B 9/04

[52] U.S. Cl. ..... 15/143.1; 15/167.1; D4/104; D4/129

[58] Field of Search ..... 128/62 A; 606/234–236; D24/152, 180, 194; D4/104–113, 127–138, 199; 15/143 R, 106, 186–188, 159 R, 160, 167.1, 167.2, 167.3, DIG. 5

[56] References Cited

U.S. PATENT DOCUMENTS

| | | | |
|---|---|---|---|
| D. 226,143 | 1/1973 | Brainerd et al. | D4/130 |
| D. 245,462 | 8/1977 | Hauf et al. | D4/129 |
| D. 299,386 | 1/1989 | Jacobs | D4/104 |
| D. 311,455 | 10/1990 | Snipes | D4/129 X |
| 871,121 | 11/1907 | D'Humy | 15/188 |
| 1,470,710 | 10/1923 | Davis . | |
| 2,396,548 | 3/1946 | Allen | 15/167.1 |
| 3,753,266 | 8/1973 | Ceniceros | 606/235 |
| 3,798,698 | 5/1974 | Conklin, Jr. | 15/167.1 |
| 4,115,893 | 9/1978 | Yuichi . | |
| 4,128,910 | 12/1978 | Yuichi . | |
| 4,454,623 | 6/1984 | O'Halloran . | |
| 4,654,921 | 4/1987 | Dinner | 15/143 R |
| 4,911,187 | 3/1990 | Castillo | 15/167.1 X |
| 4,912,801 | 4/1990 | Hammill | 15/160 |
| 5,048,143 | 9/1991 | Carroll | 15/105 X |
| 5,078,732 | 1/1992 | Ceniceros | 128/62 A X |

FOREIGN PATENT DOCUMENTS

| | | | |
|---|---|---|---|
| 651854 | 10/1937 | Fed. Rep. of Germany | 15/106 |
| 3410043 | 9/1985 | Fed. Rep. of Germany | 15/167.1 |
| 1518935 | 7/1978 | United Kingdom | 15/143 R |
| 8803772 | 6/1988 | World Int. Prop. O. | 15/167.1 |

*Primary Examiner*—Timothy F. Simone
*Assistant Examiner*—C. Cooley
*Attorney, Agent, or Firm*—John E. Reilly

[57] ABSTRACT

A toothbrush having an elongated oval or loop shaped handle having a plurality of brushing projections mounted to a portion of the outer perimeter of the handle. The elongated handle may also be flattened on one end, forming an integral base or stand, or the handle may be bisected into two halves by a cross member. Alternatively, the brushing projections may be mounted to a brush head extending radially outward from the elongated handle.

6 Claims, 2 Drawing Sheets

TOOTHBRUSH

REFERENCE TO RELATED APPLICATIONS

This application is a continuation-in-part application of Ser. No. 421,984, filed Oct. 16, 1989 for TOOTHBRUSH by Martha M. Thomas, now abandoned.

This invention relates to oral hygiene devices; and more particularly relates to a novel and improved toothbrush for use by persons with developmental or impaired motor skills, such as, infants and toddlers to facilitate gripping and manipulation of the handle with substantially less danger of swallowing the toothbrush or injuring one's self.

BACKGROUND AND FIELD OF INVENTION

Most toothbrushes for infants and young children have tended to be merely miniaturized versions of the bristle-type tooth brushes developed for adults. These miniaturized versions typically failed to recognize and make accommodations for the special brushing needs of infants and small children. One of these needs which has been recognized in the past is the need to provide a specially designed brushing or cleaning head that is more suitable for the immature structure of the milk teeth and fragile gums of infants and young children. Toward this end, several specialized brushing surfaces or cleaning heads have been developed and patented in recent years. For example, U.S. Pat. Nos. 4,115,893 and 4,128,910, both issued to Nakata et al, disclose special brushing surfaces or cleaning heads made of soft, resilient materials which effectively clean the teeth and massage the gums without causing discomfort or pain for the children. It is hoped that these newly developed brushing surfaces or cleaning heads will make brushing a more pleasant and enjoyable experience for the children, thereby helping such children to develop positive oral hygiene and brushing habits early in their lives. Further, U.S. Pat. No. 4,654,921 to Dinner discloses an infant toothbrush having a handle in the form of an oval ring to facilitate gripping by an infant and with an array of bristles extending in alignment with the major axis of the ring.

However, the development of these brush heads only goes part way toward helping children develop positive oral hygiene and brushing habits. Typically, it is easier for a parent when first instructing a child in toothbrushing to make a "game" of it, or otherwise make the learning experience as enjoyable for the child as possible. Thus, many parents may desire to allow their children to have continuous access to their toothbrushes in much the same way as parents might allow continuous access to pacifiers or other such toys that children usually enjoy placing in their mouths. Such continuous access could enhance the enjoyability of the brushing experience for the children and consequently could aid in helping the children develop positive brushing habits. Unfortunately, such a teaching technique can be dangerous with the currently available straight or elongated handle toothbrush designs due to the possible hazard of a toothbrush becoming lodged in a child's throat should he or she fall with the toothbrush in his or her mouth. For instance, a recent survey by the Consumer Product Safety Commission found that in 1988, 1,069 persons received emergency treatment for toothbrush related injuries. Of that number 62% of those were aged from zero to four years. This hazard also exists with the new brush head designs, such as, those disclosed in the Nakata patents described above because those new brush heads still use the conventional straight or elongated handle design.

Another special brushing need for infants and small children is the need for a handle design that is easy to grip and manipulate. Most current toothbrush designs with simple straight handles are very difficult for children to manipulate, because they generally lack the coordination and motor skills of adults for which most of these conventional handles are designed. Furthermore, such straight handle designs are very difficult to use by persons who have manual disabilities, such as, arthritis or coordination or motor skill deficiencies.

A most important consideration is that the handle be of a size and configuration that will alleviate trauma should the user fall at an angle in which one of the corners of the handle could stab the user. At the same time, it is desirable that the handle can be grasped by the infant or toddler to exert stronger brushing pressure on the teeth with substantially less effort so as to result in more thorough cleaning and that the mouth contacting portion of the brush widen at an angle which will reduce the danger of trauma from injury to the back of the mouth. In this relation, it is desirable that the handle be dimensioned to prevent lodging of the toothbrush in the mouth or throat.

SUMMARY OF INVENTION

Accordingly, it is an object of the present invention to provide an improved toothbrush design that can be more easily manipulated by persons with developing or deficient motor skills.

It is another object of the present invention to provide for a novel and improved toothbrush that can be easily grasped and manipulated by an infant or toddler to exert stronger brushing pressure on the teeth with substantially less effort or force while minimizing the danger of injury to the mouth or becoming lodged in the mouth or throat.

It is a further object of the present invention to provide for a novel and improved infant and toddler toothbrush which is so constructed and arranged that it may be stored in an upright position on a tabletop or counter so as to remain cleaner and more sanitary when not in use; further to provide alternate forms of the present invention which are specifically designed for use for infants having incisor teeth only or for toddlers having molars in addition to incisor teeth.

It is an additional object of the present invention to provide for a toothbrush design that is aesthetically appealing to adults and children alike increasing the likelihood of acceptance and use.

In accordance with the present invention, a toothbrush has been devised for use by infants and toddlers which comprises an elongated generally loop-shaped handle including a hollow gripping area for insertion of the fingers of the hand, a brush-supporting portion disposed at one side of said handle intermediately between opposite ends of the handle, the handle converging forwardly from the opposite ends into the brush-supporting portion, brushing means attached to the brush-supporting portion for brushing the teeth of an infant or toddler, the handle being longer in a direction transverse to the direction of entry of the brush-supporting portion into the mouth and in a direction parallel to the direction of entry and longer in the transverse direction than the longest dimension across the mouth of the user to prevent lodging of the handle in the mouth.

In accordance with one form of the present invention, the loop-shaped handle has a hollow gripping area of generally triangular configuration including a base portion along one side of the gripping area and inclined side portions converging from opposite ends of the base portion into an intermediate brush-supporting portion at the apex of the triangular gripping area, and the bristles which define the brushing means protrude directly from the peripheral surface of the handle and is specifically adaptable for use in brushing the incisors of the infant. In a second alternate form, the bristles protrude from a stem which extends forwardly from the side or apex of the handle so that the bristles extend in a direction parallel to the length or longer dimension of the handle and is intended more for use with toddlers having molars in addition to incisors. In both forms of invention as described, a center bar bisects the triangular gripping area to facilitate grasping and manipulation of the toothbrush by the user, and the base of the gripping area is wide and flattened so that it may be stored in an upright position on a flat surface when not in use.

The above and other objects, advantages and features of the present invention will become more readily appreciated from a consideration of the following detailed description of a preferred embodiment thereof, when taken together with the accompanying drawings, in which:

DETAILED DESCRIPTION OF THE PREFERRED EMBODIMENTS

Figure 1:
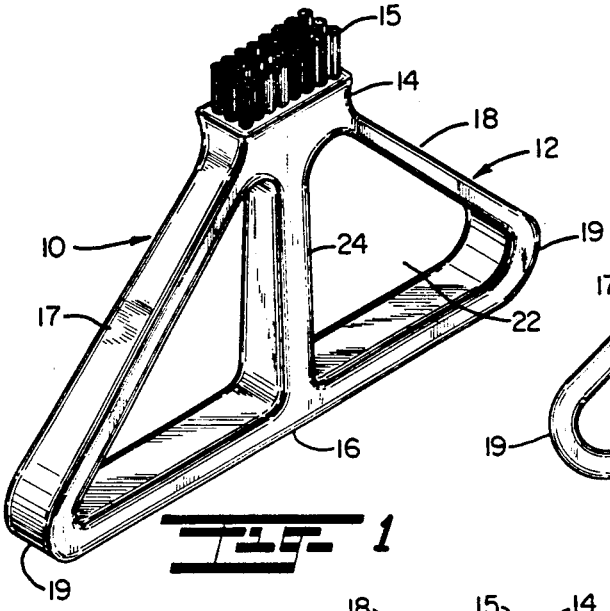
FIG. 1 is a perspective view of a preferred form of toothbrush in accordance with the present invention.
Figure 2:
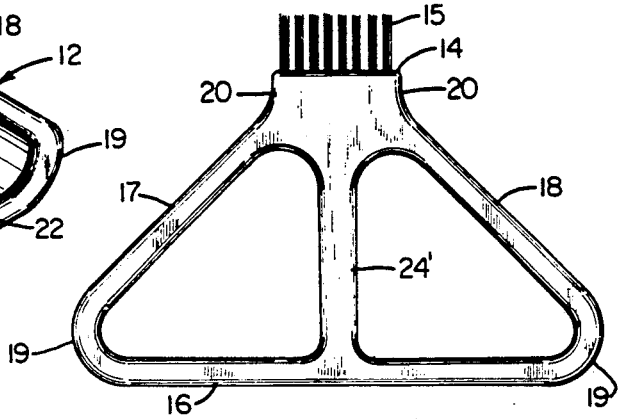
FIG. 2 is a front elevational view of the preferred form of invention shown in FIG. 1.
Figure 3:
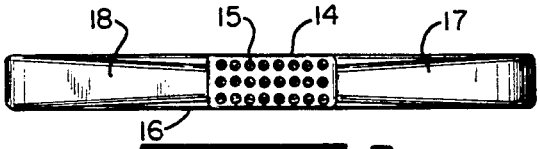
FIG. 3 is a top plan view of the preferred form of invention shown in FIG. 1.

There is illustrated in FIGS. 1 to 7 one preferred form of toothbrush 10 comprising a generally loop-shaped handle 12 having a brush-supporting portion 14 for a plurality of bristles 15. Preferably, the handle 12 is of generally triangular configuration having a base 16 and inclined side portions 17 and 18 which converge away from opposite rounded ends 19 of the base into opposite ends of the brush-supporting portion 14 at the side of the triangle opposite to the base 16. As such, the base 16 together with the side portions 17 and 18 define a hollow or open gripping area 22 which is bisected by a common center bar 24 extending from the base 16 and into the brush-supporting portion 14.

The toothbrush 10 is specifically designed for use by infants in order to encourage good oral hygiene. Thus, the infant can be trained to grasp the handle 12, and the gripping area 22 is sized such that the infant can conveniently pass the fingers of one hand into the gripping area and around the base member 16 and on either side of the center bar 24. In this relation, the center bar 24 will offer additional stability and assist the infant in manipulating or turning the handle as the bristles 15 are brought into contact with the teeth. In brushing, the bristles 15 and brush-supporting portion 14 are intended for brushing the front teeth or incisors. In order to prevent the handle from being accidentally forced into or becoming lodged in the mouth, it is sized such that the base 16 is longer in a direction transverse to the direction of entry of the brush-supporting portion 14 into the infant's mouth than in a direction parallel to the direction of entry and is longer in the transverse direction than the longest dimension across the infant's mouth. In turn, the sides 17 and 18 of the handle have gently sloping surfaces which converge forwardly as described so that in the event that the infant should fall, or the handle should be accidentally forced against the mouth will minimize the danger of damage to the infant's mouth.

Figure 4:
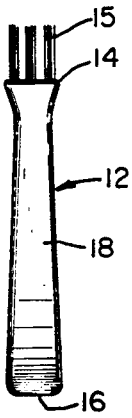
FIG. 4 is a right side view of the preferred form shown in FIG. 1.
Figure 5:
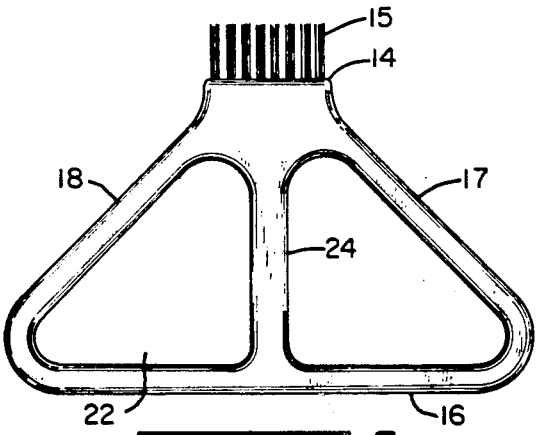
FIG. 5 is a rear elevational view of the preferred form shown in FIG. 1.
Figure 6:
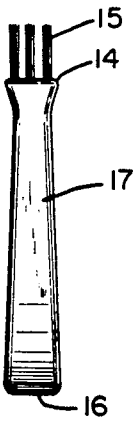
FIG. 6 is a left side elevational view of the preferred form shown in FIG. 1.
Figure 7:
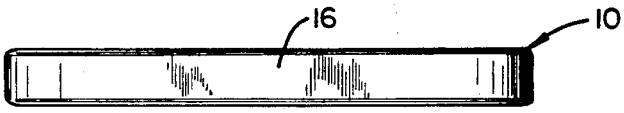
FIG. 7 is a bottom plan view of the preferred form shown in FIG. 1.
Figure 8:
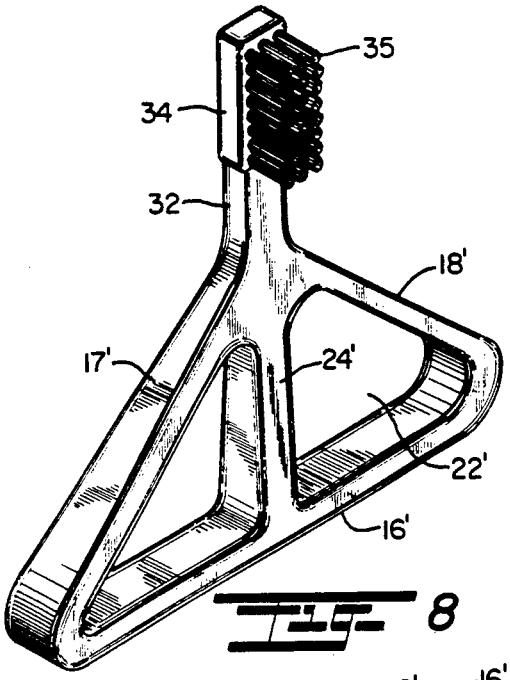
FIG. 8 is a perspective view of an alternate form of toothbrush in accordance with the present invention.
Figure 9:
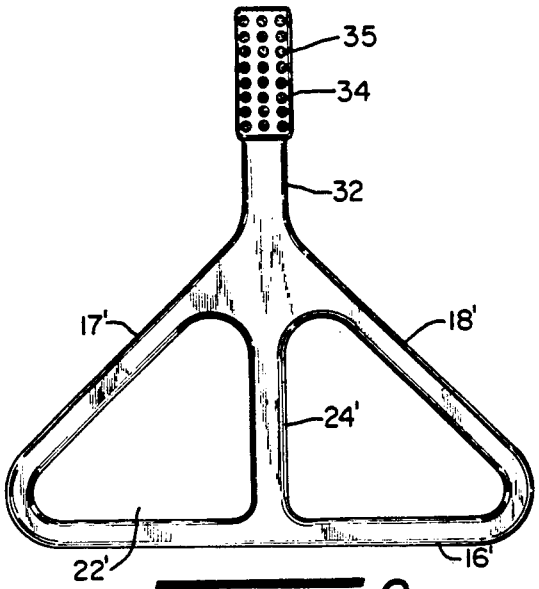
FIG. 9 is a front elevational view of the alternate form of invention shown in FIG. 8.
Figure 10:
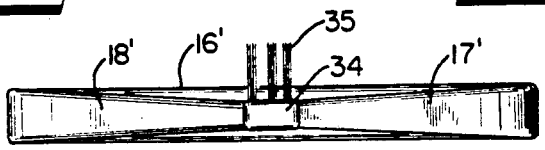
FIG. 10 is a top plan view of the alternate form of invention shown in FIG. 8.
Figure 11:
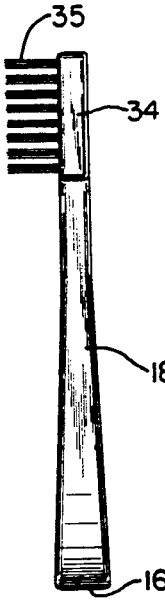
FIG. 11 is a right side view of the alternate form shown in FIG. 8.
Figure 12:
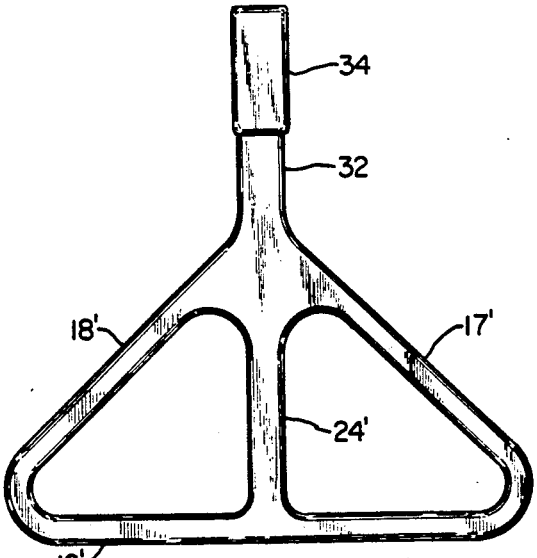
FIG. 12 is a rear elevational view of the alternate form shown in FIG. 8.
Figure 13:
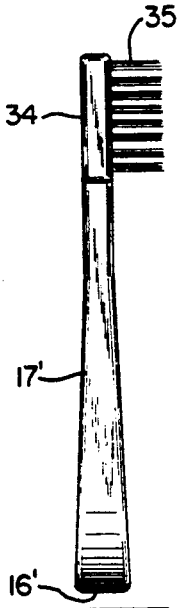
FIG. 13 is a left side elevational view of the alternate form shown in FIG. 8.
Figure 14:
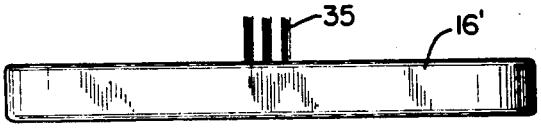
FIG. 14 is a bottom plan view of the alternate form shown in FIG. 8.

The toothbrush 10 can be composed of a rigid resin or plastic material of the type used in conventional toothbrush handles, or in the alternative can be made from softer more resilient materials of the type commonly used in toys made especially for infants. The brush-supporting portion may be given a thicker cross-section, as illustrated in FIGS. 4 and 6 to provide a natural "grip" by which a child can more easily retain the toothbrush in his or her mouth. The bristles 15 are preferably composed of a soft bristle material commonly used for toothbrushes and may be attached to the portion 14 by embedding or anchoring the ends in accordance with well-known practice. Of course, the bristles 15 can be made in a range of stiffnesses and lengths ranging from very soft bristles for teething infants to firmer bristles for young children; and, in the alternative, the brush structure may comprise other projections as will be more fully described below. In addition, the base 16 is preferably given a wider cross-section, as illustrated in FIGS. 4 and 6, so that the toothbrush can be placed in an upright position, as shown in FIG. 1, when not in use. In this way, the toothbrush may remain cleaner and more sanitary and can be more easily grasped or picked up by an infant or adult.

An alternate preferred form of invention is illustrated in FIGS. 8 to 13 in which like parts to those of FIGS. 1 to 7 are correspondingly enumerated with prime numerals. Thus, the toothbrush 10' comprises a generally loop-shaped handle 12' of generally triangular configuration having a base 16' and inclined side portions 17' and 18' which converge away from the base into a common brush-supporting portion 30. The base 16' together with side portions 17' and 18' form a common gripping area 22' which is divided by a common center bar 24' extending from the midsection of the base and intersecting the upper convergent ends of the sides 17' and 18'.

The alternate form of invention is intended for use with infants, or toddlers, having molars in addition to incisors and is therefore designed with a stem portion 32 extending away from the convergent ends of the sides 17' and 18' so as to extend in a direction normal to the length of the base member 16' and terminate at its free end in a brush or bristle head 34 having a plurality of bristles 35. Preferably, the bristles 35 extend in a direction normal to a plane passing through the handle 12 and brush-supporting portion 30 so that when the user grips the handle by passing the fingers of one hand through the gripping area 22' the bristles 35 will face in the same direction as the inside of the hand. In this way, the user will be encouraged to extend the brush-supporting portion 30 into the mouth with the bristles in facing relation to the tooth surfaces to be cleaned and the user can more easily manipulate or vary the angle of the bristles in brushing the teeth. The stem 32 can be dimensioned to be of different lengths to provide a full range of toothbrushes of appropriate size to reach the rearwardmost molars from early infant years up to adult years. Accordingly, the stem 32 can be made longer and the triangular handle or gripping area larger according to the size and development of the user.

Although the forms of invention illustrated in FIGS. 1 to 14 are comprised of bristles 15 and 35, other types of brush or massage devices may be utilized, such as, those comprising a plurality of fin-like projections of rubber or rubber-like material and designed more for massaging. Moreover, the bristles may be designed with varying degrees of softness and length in accordance with conventional practice.

It is therefore to be understood that the foregoing and other modifications and changes may be made in the construction and arrangement of elements comprising the forms of invention as herein set forth and described without departing from the spirit and scope thereof as defined by the appended claims and reasonable equivalents thereof.

I claim:

1. A toothbrush for use by infants comprising:

an elongated, generally triangular-shaped handle having a plurality of sides, said handle including a hollow gripping area for insertion of the fingers of the infant's hand, a brush-supporting portion disposed at one side of said handle intermediately between opposite ends of said handle, and said handle having converging portions extending from said opposite ends into said brush-supporting portion, wherein said gripping area is of generally triangular shape, said handle having a flat base portion on a side opposite to said one side of said handle; and brush means attached to said brush-supporting portion for brushing the teeth of an infant, said handle being longer in a direction transverse to a direction of entry of said brush-supporting portion into the infant's mouth than in a direction parallel to said direction of entry and being longer in said transverse direction than the longest dimension across the infant's mouth to prevent lodging of said handle in the infant's mouth.

2. A toothbrush according to claim 1, said converging portions of said handle having sloping surfaces converging into said brush-supporting portion, and said brush means comprising a plurality of bristles extending from said brush-supporting portion.

3. A toothbrush according to claim 1, including a cross member substantially bisecting said gripping area.

4. A toothbrush according to claim 1, said brush-supporting portion extending in a direction transverse to said direction of entry and said brush means extending in a direction parallel to said direction of entry.

5. A toothbrush for use by infants comprising:

a generally triangular shaped handle having a plurality of sides, said handle including a hollow gripping area of generally triangular configuration dimensioned for insertion of the fingers of an infant's hand, said handle including a flat base portion along one side of said handle and inclined side portions converging from opposite ends of said base portion into a brush-supporting portion intermediate said opposite ends, and a bar extending across said gripping area; and brush means attached to said brush-supporting portion for brushing the teeth of an infant, said handle being longer in a direction transverse to a direction of entry of said brush-supporting portion into the infant's mouth than in a direction parallel to said direction of entry and longer in said transverse direction than the longest dimension across the infant's mouth to prevent lodging of said handle in the infant's mouth, said brush-supporting portion including a stem extending parallel to said direction of entry and said brush means disposed at a free end of said stem and extending transverse to said direction of entry.

6. A toothbrush according to claim 5, said bar substantially bisecting said gripping area.

* * * * *